United States Patent [19]

Gregory

[11] Patent Number: 4,473,323

[45] Date of Patent: Sep. 25, 1984

[54] BUOYANT ARM FOR MAINTAINING TENSION ON A DRILLING RISER

[75] Inventor: Edward W. Gregory, Calgary, Canada

[73] Assignee: Exxon Production Research Co., Houston, Tex.

[21] Appl. No.: 484,753

[22] Filed: Apr. 14, 1983

[51] Int. Cl.[3] ..... E02D 5/74

[52] U.S. Cl. ..... 405/224; 405/195; 114/265; 166/350

[58] Field of Search ..... 405/195–209, 405/211, 212, 224–227; 114/264, 265; 166/350, 359, 368

[56] References Cited

U.S. PATENT DOCUMENTS

| | | | |
|---|---|---|---|
| 2,525,955 | 10/1950 | Scott | 114/265 X |
| 3,327,668 | 6/1967 | Schultz | 114/265 |
| 3,519,036 | 7/1970 | Manning | 114/264 X |
| 3,835,655 | 9/1974 | Oliver | 166/350 X |
| 4,400,110 | 8/1983 | Beynet et al. | 405/195 |

*Primary Examiner*—Dennis L. Taylor

*Attorney, Agent, or Firm*—E. Thomas Wheelock; Richard F. Phillips

[57] ABSTRACT

The invention relates to an elongated buoyant arm mounted below the water line of a drilling vessel. The arm is of variable buoyancy and is attached to a drilling riser extending between the drilling vessel and the sea bottom to maintain tension on the riser.

14 Claims, 4 Drawing Figures

106
104
108
110
112
124
128
126
114
102
116
118
122
120

BUOYANT ARM FOR MAINTAINING TENSION ON A DRILLING RISER

BACKGROUND OF THE INVENTION

1. Object of the Invention

This invention relates to a buoyant arm for maintaining tension on a riser, in particular a drilling riser, used on a floating or semi-submersible petroleum drilling or production platform.

2. Field of the Invention

The search for new oil aand gas fields has led to increasing amount of drilling activity in offshore locations. Drilling or producing from subsea offshore wells, particularly in deep water, typically requires the use of a floating vessel from which to conduct operations. A "riser" communicates the vessel with the wellhead and must be maintained relatively straight and is, therefore, constantly under tension. A riser operating on a floating vessel in water depths greater than about 200 feet can buckle under the influence of its own weight and the weight of drilling fluid contained within the riser if the riser is not maintained in tension. This axial tension must be applied either to the top of the riser or result from buoyancy attached along the length of the riser. The tension controls the stress in the riser and affects its straightness. It should be apparent that as water depth increases, the axial tension required to provide proper support also increases.

A "drilling riser" is a conduit which serves essentially the same function as does well casing on an onshore well. It encloses the drill string and provides a pathway for the drilling fluids or "mud" to return to the floating drilling platform. The drilling mud is, of course, pumped down through the hollow interior of the drill string, out orifices found in the drill bit, and back up the annular space between the outside of the drill string and the inside of the drilling riser.

There are a number of methods for tensioning risers. Two known ways provide for the use of counterweights or pneumatic spring systems at the top of the risers. Use of a counterweight was an early technique for applying tension to the top of a marine riser. The weight is hung from a wire rope which is in turn run over sheaves and down to the top of the riser pipe. As the vessel moves up and down, the counterweight moves up and down and maintains tension on the top of the riser. The tension on the riser is equal to the weight of the counterweight. The tension varies significantly due to the acceleration of the counterweight when the vessel heaves. Consequently, the method is only practical for calm shallow water locations requiring only low tension.

The pneumatic spring systems replaced the counterweight systems as deep water and severe weather drilling evolved. These devices utilize a cylinder containing compressed air to apply tension to the top of the riser through wire ropes. These devices act as oil damped pneumatic springs. A large air supply maintains a nearly constant pressure above the oil in an air-oil accumulator vessel. The oil then provides pressure via a hydraulic line to the face of a moving piston. As the floating vessel moves up and down, the piston moves in a similar manner and thereby provides a relatively constant force in the lines attached to that piston. A series of sheaves are provided on the tensioner so that the length of the piston stroke will be substantially less than the scope of the vessel movement.

Tensioner systems proposed in the past are subject to several disadvantages; one disadvantage being that the tensioning lines often fail under high tension. Failure in this manner is typically attributed to fatigue caused by the continuous bending of the cable as it rolls back and forth over the sheaves. Another problem is that conventional tensioning systems with the capacity to provide the tension for deep water drilling may be inordinately massive. The mass and the high tension can adversely affect vessel stability.

The inventive drilling riser system with its buoyant arm disclosed herein helps to minimize these problems. The invention may be used with any number of different of drilling vessels, although it is particularly suited with the caisson vessel type which has a vertical chamber extending through the center of the vessel through which a drill string is extended. Other vessels having such a central chamber are known. For instance, the description found in U.S. Pat. No. 3,766,874, to Helm et al, outlines a design for a moored barge to be used in arctic offshore oil drilling. The design has a central vertical chamber through which the drill string is placed. Although no mention is made of a riser or, therefore, any riser tensioner means, certainly such apparatus would be required.

Another drilling structure having a central drilling chamber is described in U.S. Pat. No. 3,771,481, to Goren, and in U.S. Pat. No. Re. 29,478. This vessel is of the type known as "semi-submersible". It is a structure that typically has a long large central column setting upon barge-shaped catamaran hulls. A drilling deck is perched atop the central column from which both drill string and drilling riser are snaked to the ocean bottom. The vessel is known as "semi-submersible" since it has large ballast chambers allowing the vessel to be partly submerged, i.e., so that the hulls are well below the water's surface. Once so submerged, the vessel can be maintained in position by sea anchors. No mention is made of the manner in which the riser is tensioned; nor is any mention made of the method by which the riser is held away from the interior of the central column walls.

Another semi-submersible drilling structure is found in U.S. Pat. No. 4,004,531, to Mott. This vessel contains a central chamber denominated a "caisson" which extends down from the drilling deck to below the water surface and is designed to protect the drilling riser from wave forces. A slip joint is placed in the riser string within the caisson to decouple vertical vessel motion from the riser. A joint allowing pivoting action about the riser is also included in the riser string. The riser tensioner disclosed apparently is of the air pressure type mentioned above. The patent discloses an additional embodiment intended to lessen the load of the mechanical riser tensioner. In the latter embodiment, a number of air-filled rubber bladders are attached to the riser below the water line. The buoyancy of the bladders creates tension on the riser and, depending on the size of the bladders, could either eliminate the need for a mechanical tensioner or at least reduce the size thereof.

A floating or semi-submersible vessel suitable for production or pumping petroleum from a sea bed floor storage facility is disclosed in U.S. Pat. No. 4,212,561, to Wipkins. The apparatus disclosed therein utilizes a central column through which a riser is inserted. The riser is maintained within the center of that column by a set of rollers and floats. The portion of the riser extending from the sea bed floor is made buoyant apparently by collars affixed about the riser itself. The upper end of the riser has a swivel joint at the point it enters the central column to decouple the roll motion of the vessel from the riser.

SUMMARY OF THE INVENTION

The present invention deals with a buoyant arm mounted below the water-line of a vessel which arm is suitable for maintaining a riser in tension. It is adapted to decouple both rolling and heaving motions from the riser. The present invention is especially suitable for maintaining a drilling riser positioned in the middle of a moonpool.

The arm itself is pivotably mounted below the water line. It has buoyant can or cans, which can be ballasted or deballasted, mounted on the arm. The arm or the cans may have foam buoyancy which, desirably, could render the arm neutrally buoyant. The free end of the arm is centered below the drilling deck and has a joint mounted on it which allows the riser to swivel.

DESCRIPTION OF THE PREFERRED EMBODIMENTS

Figure 1:
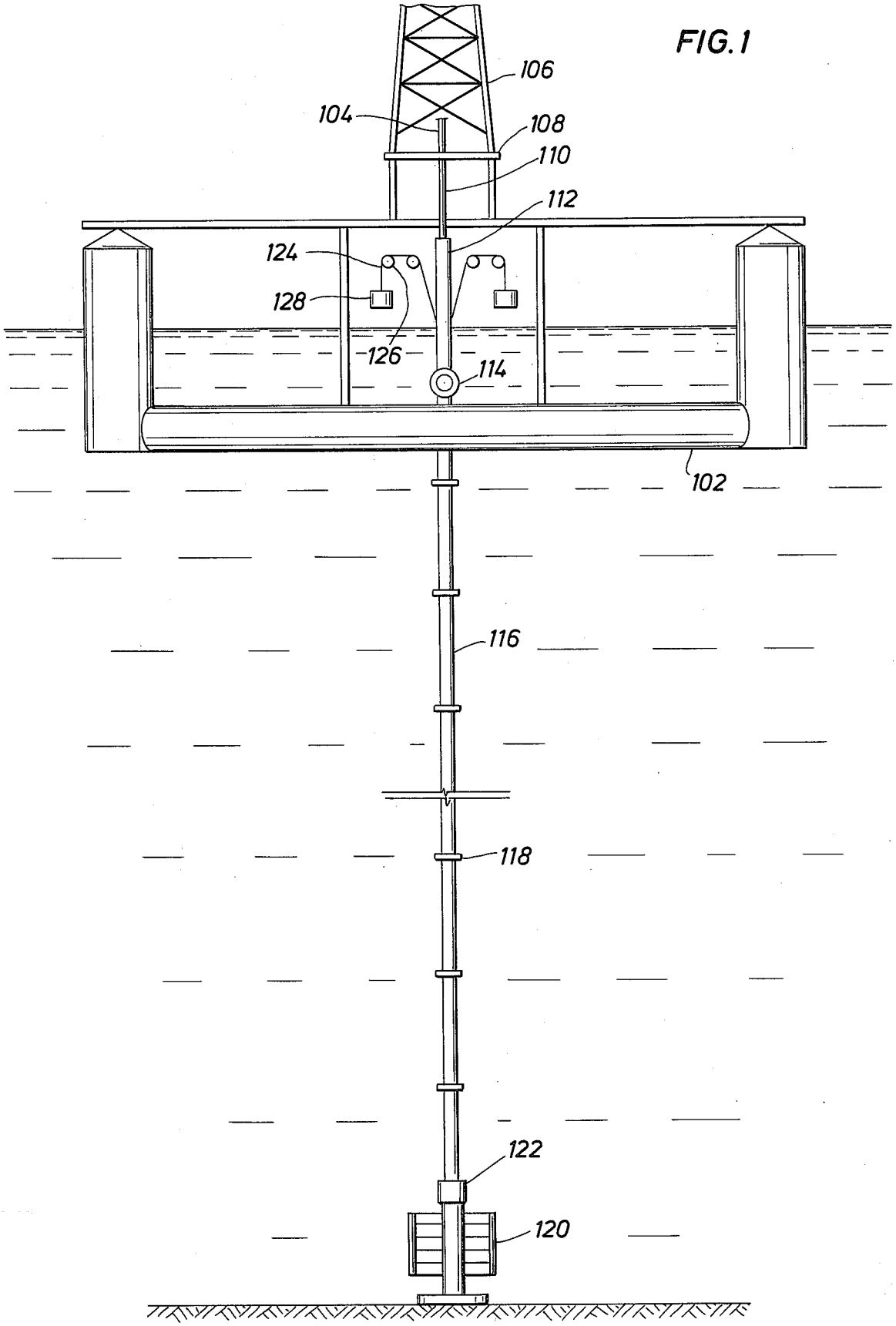
FIG. 1 is a schematic elevation view of a drilling vessel floating on a water body and showing various apparatus generally used in the prior art.

Illustrated in FIG. 1 is a semi-submersible vessel similar to those found in those patents discussed above. The drilling of a well from such a vessel takes place by running a drill string 104, composed of a drill bit and drill pipe, down from a derrick 106 through the drilling deck 108 into a slip joint inner barrel 110, a slip joint outer barrel 112, an upper flexible joint 114 (in some deep water installations), and through a series of riser sections 116. The riser sections 116 are often 40 to 50 feet in length and connected at couplings 118. The drilling riser assembly has, at its lower end, a blowout prevention device 120 and a ball joint 122.

The riser assembly comprising upper flexible joint 114, riser sections 116, riser section couplings 118 and ball joint 122 is capable of some flexure. Since the riser sections 116 are typically manufactured of steel and are not amenable to large flexures, there is a need to maintain the riser assembly in tension. This tension is maintained in the apparatus of FIG. 1 by riser tensioner lines 124 which are run over a number of sheaves 126 and thence to riser tensioner weights 128. It should be apparent that for a given water current tending to bend the riser assembly, increased poundage of the riser tensioner weights 128 will result in a smaller bend in the riser assembly. On installations in which heavy wave action is expected, an air pressure system is installed to maintain tension on the riser tension lines 124. As mentioned above, sheave arrangements are used which result in a movement of the tensioner weight which is significantly smaller than the movement of the vessel.

It should be clear that maintenance of tension on riser is most important. Kinking or substantial bending of a drilling riser is intolerable. Drilling vessels other than the type illustrated in FIG. 1, such as drill ships have an additional problem in that the structure around the slip joint, illustrated by inner barrel 110 and outer barrel 112, is not open. Other designs for floating platforms, such as that disclosed for use with the instant invention, have an essentially round hollow chamber communicating between the drilling deck and the water.

Figure 2A:
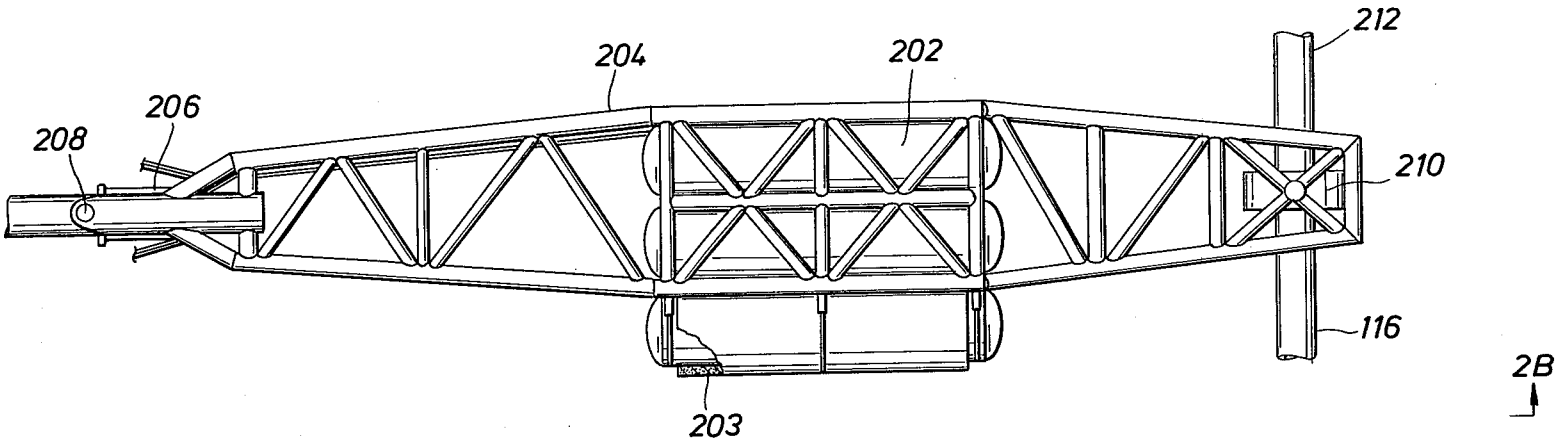
FIGS. 2A and 2B show side and top views of one embodiment of the buoyant arm used in this invention.
Figure 2B:
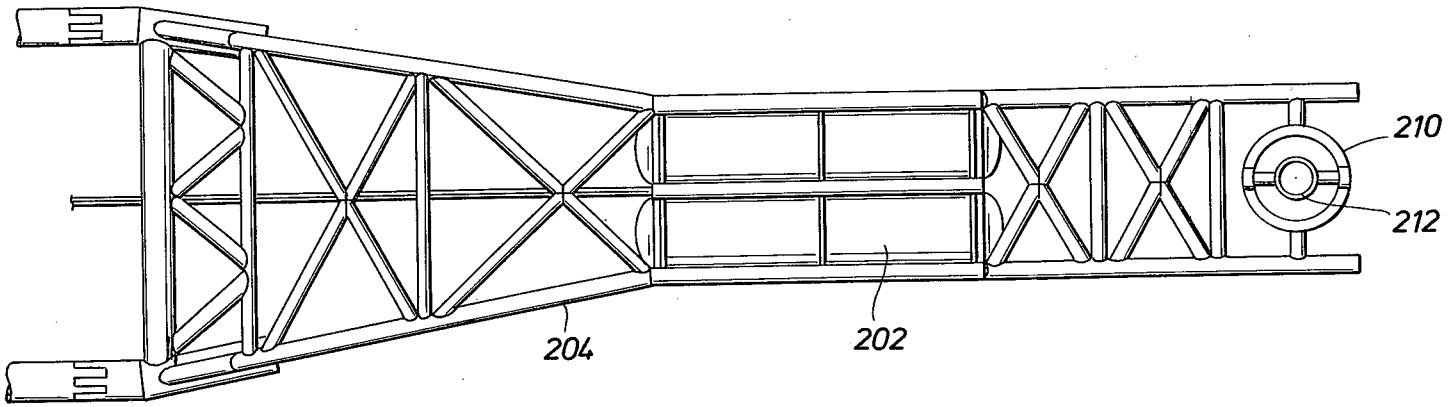

FIGS. 2A and 2B show, respectively side and top views of the inventive buoyant tensioner arm. This tensioner arm is placed below the level of the water and relies on the buoyancy of air contained in a number of buoyancy tanks to maintain tension on the attached riser. In FIG. 2A the buoyancy tanks 202 are placed in the middle of the arm 204. An air line 206 extends from the tanks 202 along the arm 204 past the arm hinge 208 and up into the drilling vessel. The number of buoyancy tanks is not particularly important. There may be one or more depending upon size and need. Buoyancy foam jackets 203 or means are shown in partial cutaway on tanks 202. The buoyancy foam may be attached in an amount to render the arm neutrally buoyant. The foam may be attached to the arm 204 itself. Ballast in tanks 202 may be varied to change the amount of buoyancy inherent therefrom. Riser section 116 is shown at the free end of the buoyant arm below joint 210. A joint 210 or other pivot device is mounted in the outer end of the arm 204. Joint 210 is configured so that the riser 116 is free to swivel or pivot about a first axis, the center of the joint, and yet maintain moonpool riser section 212 generally in the center of the moonpool. The riser 116 is also free to rotate about a second axis within joint 210. The end of arm 204 is open so that the joint 210 may be detached from the arm 204 or riser 116 may be detached from the joint 210 so the arm swings down and away from the riser.

Figure 3:
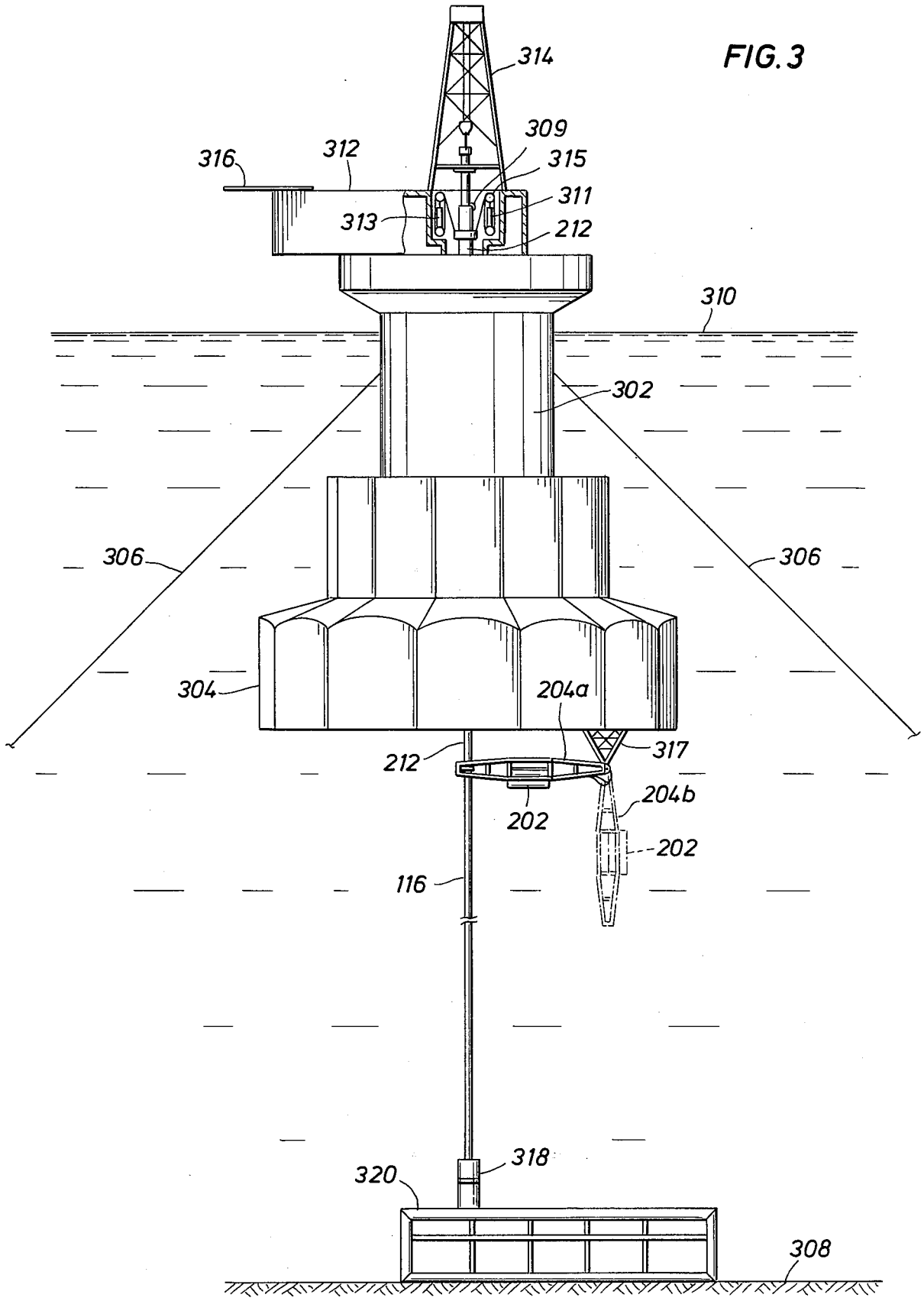
FIG. 3 is a schematic view of a caisson-type drilling vessel floating on a body of water and provided with the buoyant tensioning arm.

FIG. 3 depicts the buoyant arm **204*a* in position beneath a caisson vessel 302. The caisson vessel 302 itself can be quite large; for instance, the hull diameter at the ballast tanks 304 may be upwards of 300 feet. Obviously the buoyant arm 204*a* in this example may be 100 feet or more in length. The caisson vessel may be made from concrete and floated from site to site. The vessel is held in place by a number of conventional mooring lines 306 which may be connected to large clump weights on the seafloor 308 in series with anchors. Alternatively, the mooring lines 306 may be connected only to the anchors. It should be apparent that most of the caisson vessel 302 is found beneath the surface of the sea 310**.

The caisson vessel 302 has a drilling deck 312 upon which is situated a drilling derrick 314. A helicopter pad 316 may be situated nearby. Drilling takes place by extending a drill string 309 down from the drilling derrick 314, down through the moonpool in the center of the casisson vessel and through the joint 210. The drill string 309 is completely encased by moonpool drilling riser 212 above the joint 210 and by the remainder of the drilling riser 116 below the joint 210. The riser 116 may be completely or partially covered with the buoyancy equipment discussed above. The riser connects with a blowout preventer stack 318 and possibly a template 320 situated on the sea bottom 308.

Even though the caisson vessel design is exceptionally stable because of its low center of gravity, it will still move about in the water under the influence of ocean and wind currents. The buoyant arm **204*a* maintains a constant tension on the drilling riser 116 to prevent it from kinking and bending. The buoyant arm 204 is typically attached to the bottom of the vessel on a support pylon 317. The distance that the pivot point on buoyant arm 204 is placed below the bottom is a matter of choice and design depending upon the depth of water and expected sea conditions. The riser may be attached to various devices on the sea bottom against which the buoyant arm may pull. It should be apparent that a slip joint 309 and tensioner apparatus comprising wire rope 311, hydraulic-pneumatic tensioner 313, and sheaves 315 may be placed interior to the caisson vessel to maintain tension on moonpool drilling riser 212**.

The buoyancy tanks 202 on buoyant arm 204*a* may be ballasted, at least partially, with water and the arm dropped into the position depicted by arm 204*b*. In this position, the buoyant arm 204*b* is completely out of the way of the moonpool so that tools and equipment may be inserted down through the moonpool and placed on the sea bottom. If desired, the drilling riser 116 may be disconnected from the seafloor apparatus, shortened by the length of the buoyant arm, and left attached to the buoyant arm. Should the driller wish to move the caisson vessel or merely wish to perform some other operation with the riser out of the way; the non-buoyed position of arm 204*b* provides such a situation. In using this feature, the driller is not required to perform the expensive task of removing several thousand feet of riser.

The foregoing disclosures and description of the invention are only illustrative and explanatory thereof. Various changes in the size, shape and materials of construction as well as in the details of the illustrated construction and operation, may be made within the scope of the applied claims without departure from the spirit of the invention.

I claim as my invention:

1. An apparatus suitable for mounting on a drilling vessel and maintaining tension on a riser which traverses a depth of water comprising:

an upper riser section having an upper end and a lower end, at least one lower riser section having an upper end and a lower end, an elongated arm having first and second ends and adapted to rotate vertically about said first end, pivot means affixed to said second end of said elongated arm, said pivot means being adapted to detachably hold the lower end of said upper riser section and the upper end of said lower riser section and further adapted to allow said lower riser section to pivot, at least one buoyancy tank mounted on said elongated arm a spaced distance from said first end and being adapted to be ballasted and deballasted, and upper tension means located at the upper end of said upper riser section and adapted to maintain said upper riser section in tension.

2. The apparatus of claim 1 wherein said upper and lower riser sections are drilling riser sections.

3. The apparatus of claim 1 wherein said pivot means comprise a joint adapted to permit pivoting of said riser about two axes.

4. The apparatus of claim 1 wherein said at least one buoyancy tank is covered with sufficient buoyancy foam means to make said elongated arm about neutrally buoyant.

5. The apparatus of claim 1 wherein said at least one buoyancy tank is adapted to be at least partially filled with water.

6. The apparatus of claim 1 wherein said upper tension means comprise weights a hydraulic cylinders adapted to maintain tension on said upper riser section through wire rope means.

7. A drilling vessel comprising:

vessel means capable of floating, having a drilling deck located above a water line, a bottom below said water line and a moonpool extending from said drilling deck to said bottom, an upper riser section having an upper end located in the region of the drilling deck and a lower end located in the region of said bottom, said upper riser section extending through said moonpool, a lower riser section having an upper section located in the region of said bottom and a lower end located a depth of water below said bottom, an elongated arm having a first end attached to said bottom, said arm adapted to rotate vertically about said first end, and having a second end located proximate to the moonpool at the bottom, pivot means affixed to said second end of said elongated arm, said pivot means mounted between and adapted to detachably hold the lower end of said upper riser section and the upper end of said lower riser section and further adapted to allow said lower riser section to pivot, at least one buoyancy tank attached to said elongated arm and adapted to be ballasted and deballasted, and upper tension means located in the region of the drilling deck and adapted to hold the upper end of said upper riser section and maintain said upper riser section in tension.

8. The vessel of claim 7 wherein said upper and lower riser sections are drilling riser sections.

9. The vessel of claim 7 wherein said pivot means comprise a joint adapted to permit pivoting of said riser about two axes.

10. The vessel of claim 7 wherein said at least one buoyancy tank is adapted to be at least partially filled with water.

11. The vessel of claim 7 wherein said upper tension means comprise weights or hydraulic cylinders adapted to maintain tension on said upper riser section through wire rope means.

12. The vessel of claim 7 wherein said vessel means comprise a caisson vessel.

13. The vessel of claim 7 wherein said vessel may comprise a semi-submersible.

14. Apparatus for maintaining tension on a riser extending between a floating offshore structure and the seafloor, said apparatus comprising:

an elongated arm having opposed first and second ends, said first end being adapted to be pivotally connected to a submerged portion of said floating offshore structure for allowing pivoting movement of the elongated arm about a substantially horizontal axis;

a buoyancy tank attached to said elongated arm a spaced distance from said elongated arm first end;

means for selectively ballasting and deballasting said buoyancy tank, said buoyancy tank and elongated arm together being non-buoyant in response to said buoyancy tank being ballasted and being buoyant in response to said buoyancy tank being deballasted, whereby said elongated arm second end pivots downward to a position below said first end in response to ballasting of said buoyancy tank and pivots upward in response to deballasting of said buoyancy tank; and a coupling element situated at said elongated element second end, said elongated arm being sized and arranged on said floating offshore structure such that in response to being deballasted, the elongated arm pivots upward to a position such that said coupling element comes into abutment with a corresponding abutment portion of said riser, preventing further upward movement of said elongated arm, whereby the buoyant force of the deballasted elongated arm is applied to said riser.

* * * * *